United States Patent [19]

Wiberg

[11] Patent Number: 4,743,049

[45] Date of Patent: May 10, 1988

[54] FOLDER SYSTEM

[75] Inventor: Olle Wiberg, Storvreta, Sweden

[73] Assignee: Esselte Almanacksforlag AB, Solna, Sweden

[21] Appl. No.: 47,015

[22] Filed: May 6, 1987

Related U.S. Application Data

[63] Continuation of Ser. No. 806,272, Dec. 6, 1985, abandoned.

[30] Foreign Application Priority Data

Dec. 18, 1984 [SE] Sweden ..... 8406434

[51] Int. Cl.[4] ..... B42D 3/00

[52] U.S. Cl. ..... 281/31; 281/17

[58] Field of Search ..... 281/15 R, 16, 17, 29, 281/31, 33, 36, 37; 402/73, 74, 76; 40/16, 15, 21, 59, 405, 537

[56] References Cited

U.S. PATENT DOCUMENTS

| | | | |
|---|---|---|---|
| 1,698,828 | 1/1929 | Smith | 281/31 |
| 2,475,067 | 7/1949 | Wege | 281/17 |
| 3,021,156 | 2/1962 | Coillot | 281/17 |
| 3,267,841 | 8/1966 | Metcalf | 281/17 |
| 4,519,629 | 5/1985 | Podosek | 281/31 |
| 4,605,245 | 8/1986 | Weaver | 281/31 |
| 4,676,527 | 6/1987 | Palmer | 281/31 |

*Primary Examiner*—Paul A. Bell

*Attorney, Agent, or Firm*—Silverman, Cass, Singer & Winburn, Ltd.

[57] ABSTRACT

A folder system comprising a folder which has attached on the inside (2) thereof a ring mechanism (3) or corresponding device for holding hole-punched paper sheets (4). The ring mechanism (3) is placed between two side-pieces (6,7) of the folder, these side-pieces preferably being of mutually the same size. In accordance with the invention one side-piece (6) of the folder (1) incorporates a pocket (8) whose mouth (9) is located adjacent that outer edge (10) of the side-piece (6) which is parallel with the ring mechanism (3) or corresponding device. The wall of the pocket (8) located nearest the outer side (12) of the folder comprises a plastics film (11) made of a soft and stretchable plastics material.

5 Claims, 1 Drawing Sheet

FOLDER SYSTEM

Figure 1:
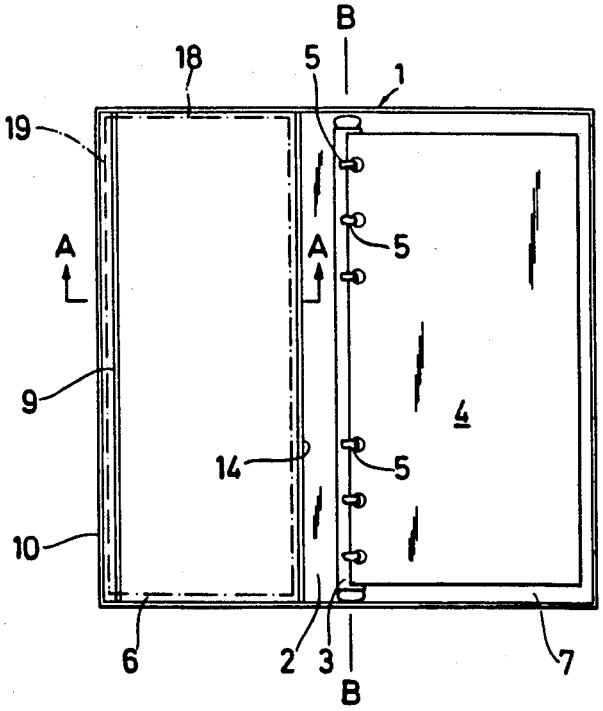

This is a continuation of application Ser. No. 806,272, filed Dec. 6, 1985, now abandoned.

The present invention relates to a folder system, or system calendar.

Recent times have seen the advent of foldable so-called fixed-ring folder systems or system calendars. These folders, or calendars are used to hold sheets of paper required by the user in the planning of his/her future activities and for making notes. More often than not these folders are devised for use at conferences and meetings etc., and are of small dimensions. When initially purchased, the folder normally contains a number of pre-printed cards or pages which are held by the ring mechanism and which may include schedule-planning cards, date calendars, etc., to enable the user to plan his/her time more readily. The folder may also include pockets for accommodating a diary, a pocket calculator and the like. The folder is intended to contain everything required by the user in planning his/her future activities, agenda, etc..

In this regard, it is desirable that the diary, or date calendar, is attached to the folder in a manner which will enable the diary to be read while simultaneously studying the pages or cards held by the ring mechanism. In some known folders this is comfortably achieved, by attaching the back cover of the diary to the ring mechanism of the folder. In cases such as these, the back cover is made longer than the top cover of the diary; in fact the length of the bottom cover is such that when attached to the ring mechanism folded residual parts of the diary lie at a given distance from the ring mechanism.

Such folder systems, however, require the provision of special diaries or like date calendars which match the folders in which they are to be used, which is a decisive drawback. The drawback mainly resides in the fact that the user wishes to use a diary or like date calendar which is made-out in a manner with which he/she is acquainted. The users of such folder systems thus desire to choose one particular diary from a number of such diaries and to attach it to the folder.

A folder system designed to accommodate a number of diaries is constructed so that the top cover of the diary chosen can be inserted in a pocket located in the folder, with the mouth of the pocket extending parallel with the ring mechanism and lying in the close proximity thereof. The pocket thus extends partially across one of the two side flaps of the folder.

The ring mechanism is normally placed between the sidepieces of the folder. Although such folder systems enable the user to choose a particular diary from a number of diaries available, the drawback remains that when the diary is opened, the cover and pages of the diary which lie on the right-hand side obscure the sheets held by the ring mechanism. This makes it difficult to leaf through the diary and through the sheets held by the ring mechanism at one and the same time.

The present invention solves the aforementioned problem and offers a solution which enables a diary chosen from a wide variety of standard diaries to be detachably connected to a folder system with the spine of the diary located close to the outer edge of one side-piece of the folder.

Accordingly, the present invention relates to a folder system incorporating a folder which has fastened to the inside thereof, between two folder side-pieces of preferably equal size, a ring mechanism or corresponding device which is intended to hold hole-punched paper sheets, and is characterized in that the one side-piece of the folder incorporates a pocket whose mouth lies adjacent that outer edge of the side-piece which extends parallel with the ring mechanism or corresponding device; and in that the pocket wall lying nearest the outer side of the folder comprises plastics film made from a soft and stretchable plastics material.

Figure 2:
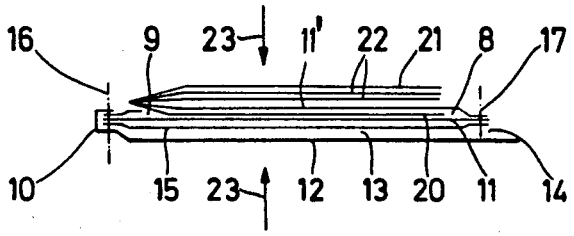

The invention will now be described in more detail with reference to an embodiment thereof illustrated in the accompanying drawing, in which;

FIG. 1 is a plan view of a folder system according to the invention when opened out; and FIG. 2 is a sectional view taken on the line A-A in FIG. 1.

FIG. 1 illustrates a folder system 1 comprising a folder which can be folded along a folding line referenced B-B in FIG. 1. The folder system 1 further comprises a ring mechanism 3 which is intended to hold hole-punched sheets 4 and which is attached to the inside 2 of the folder.

The ring mechanism 3 is of a conventional type, an comprises a number of openable split-rings 5. The ring mechanism is placed between two side-pieces 6,7 of the folder, said side-pieces preferably being of the same size. In accordance with the invention one side-piece 6 of the folder system 1 has a pocket 8, FIG. 2, the mouth 9 of which is located at that edge 10 of the side-piece 6 which extends parallel with the ring mechanism. The pocket 8 thus extends in over the side-piece 6. In accordance with the invention, the wall 11 of the pocket 8 located nearest the outer side 12 of the folder comprises plastics foil having a thickness of about 1 mm and made from a soft and stretchable material, for example polyvinyl chloride (PVC).

The folder also suitably includes additional pockets for keeping banknotes or the like, of which one pocket 13 is illustrated in FIG. 2, the pocket having an opening 14 located adjacent to the ring mechanism 3 and extending parallel therewith.

In FIG. 2 the references 11 and 11' identify the walls of the firstmentioned pocket 8, while references 12 and 15 identify the walls of the pocket 13.

The references 16 and 17 in FIG. 2 identify seams which hold the various walls together. The walls are shown in a mutually separated state for the sake of illustration.

In accordance with one preferred embodiment of the invention the firstmentioned pocket 8 is placed along the edge 10 of the left-hand side-piece 6 of the folder, as seen when the folder is opened out.

There is available commercially a large number of diaries of different design having cardboard or paper covers which are laminated with a plastics material so as to present a plastics outer surface. The person using the folder system is able to choose a diary, or like date calendar suitable for his/her needs from the multitude of various diaries available.

The intention is to insert the back cover of such a diary into the firstmentioned pocket 8, so that the spine 19 of the diary 18 lies close to the edge 10 of the left-hand side-piece 6. FIG. 1 shows the diary 18 in chain lines, with the diary closed. FIG. 2 illustrates the back cover 20 of the diary inserted in the pocket 8, while the front cover 21 of the diary, including diary pages 22 lie on top of the inside 2 of the folder 1.

Subsequent to inserting the back cover 20 into the pocket 8, the left-hand side-piece 6 of the folder is pressed together in the direction of the arrows 23, i.e. at right angles to the plane of the paper in FIG. 1, thereby to expel air present between the plastics outer surface of the cover 20 and the pstics foil 11. In this way there is achieved an adhesion created by the partial vacuum prevailing between the outer plastics surface and the plastics foil. Tests have shown that perfectly satisfactory adhesion can be achieved irrespective of the type of plastics-laminated covers found on the diary used. Preferably, however, there is used a diary having a size corresponding to the dimensions of the pocket 8.

The adhesion thus created prevents the diary falling from the folder, even when the folder is held vertically by its right-hand side-piece 7 and shaken.

The position of the pocket 8 eliminates the aforementioned problems with respect to turning the pages of the diary 18 and the sheets of paper 4 simultaneously. The arrangement of the plastics foil 11 in the pocket enables a large number of diaries to be used, without risk of the diaries falling from the pocket 8.

When wishing to withdraw a diary inserted into and fastened in the pocket 8, the mutually abutting plastics surfaces of the cover 20 and the plastics foil 11 are parted, by inserting a hand between said cover and said plastics foil. The diary 18 is then withdrawn.

The present invention thus enables a large number of standard diaries to be readily detachably fastened to folder systems, while enabling the spine of the diary to be placed close to one edge of the folder.

The afore description has been made solely with reference to one type of folder system, or system calendar.

It will be understood that by folder system is meant here, and in the following claims, any form of folder or like register which is intended to contain paper sheets and the like, such as sheets and pages held by a ring mechanism or corresponding device.

Consequently, the present invention shall not be considered to be restricted by the aforedescribed embodiments, since modifications can be made within the scope of the following claims.

I claim:

1. A folder system comprising:

a folder having front and back side-piece cover portions of substantially the same size and joined together at a common inner edge having an inside and an outer side;

said folder having sheet retaining means attached to the inside of said folder adjacent said common inner edge;

the improvement wherein a first one of said side-piece cover portions includes a pocket attached in separated relationship to said side-piece cover portion adjacent the inside of said folder, said pocket having a dimension substantially the same as said first side-piece cover portion and having a mouth opening along the outer edge of said cover side-piece portion spaced from said common inner edge, substantially parallel thereto and along the length thereof and having a closed inner wall adjacent said inner edge along the length thereof and closed top and bottom walls extending between the respective ends of said closed inner wall and said mouth to form said pocket closed with said mouth forming the opening thereto, said pocket having an outer wall, and adjacent the outer side of said folder and including means to secure a plastic book cover in said pocket, said securing means formed from a plastic film made of a soft and stretchable plastic material for assisting in retaining said plastic book cover in said pocket.

2. A folder system comprising:

a folder having front and back side-piece cover portions of substantially the same size and joined together at a common inner edge having an inside and an outer side;

said folder having sheet retaining means attached to the inside of said foler adjacent said common inner edge;

the improvement wherein a first one of said side-piece cover portions includes a pocket separately formed from and attached to said side-piece cover portion adjacent the inside of said folder, said pocket having a dimension substantially the same as said first side-piece cover portion and having a mouth opening along the outer edge of said cover side-piece portion spaced from said common inner edge, substantially parallel thereto and along the length thereof and having a closed inner wall adjacent said inner edge along the length thereof and closed top and bottom walls extending between the respective ends of said inner wall and said mouth to form said pocket closed with said mouth forming the opening thereto, said pocket having an outer wall, and adjacent the outer side of said folder and including means to secure a plastic book cover in said pocket, said securing means formed from a plastic film made of a soft and stretchable plastic material for assisting in retaining said plastic book cover in said pocket.

3. The folder system as defined in claim 2 having at least one additional pocket therein located between said pocket outer wall and said folder inside and having a mouth opening adjacent and substantially parallel to said common inner edge.

4. The folder system as defined in claim 2 wherein said first one of said cover portions is the left-hand side-piece cover portion of said folder when said folder is opened.

5. The folder system as defined in claim 2 wherein said plastic material is formed from a polyvinyl chloride like material.

* * * * *